US006547070B1

(12) United States Patent
Kolpin

(10) Patent No.: US 6,547,070 B1
(45) Date of Patent: Apr. 15, 2003

(54) PISTOL CASE

(75) Inventor: Ronald N. Kolpin, Berlin, WI (US)

(73) Assignee: Kolpin Outdoors, Inc., Fox Lake, WI (US)

( * ) Notice: Subject to any disclaimer, the term of this patent is extended or adjusted under 35 U.S.C. 154(b) by 0 days.

(21) Appl. No.: 09/711,316

(22) Filed: Nov. 13, 2000

(51) Int. Cl.[7] ..... B65D 85/00
(52) U.S. Cl. ..... 206/317; 190/102; 190/110
(58) Field of Search ..... 206/3, 315.1, 317, 206/579; 190/109, 102, 110

(56) References Cited

U.S. PATENT DOCUMENTS

| | | | | | |
|---|---|---|---|---|---|
| 2,536,169 | A | * | 1/1951 | Gray | |
| 4,301,898 | A | * | 11/1981 | Plough et al. | 150/117 |
| 4,386,642 | A | * | 6/1983 | Durbin | 190/110 |
| 4,463,789 | A | * | 8/1984 | Leiserson | 190/110 |
| 4,609,084 | A | * | 9/1986 | Thomas | 190/110 |
| 5,065,847 | A | * | 11/1991 | Hsieh | |
| 5,228,546 | A | * | 7/1993 | Chang et al. | 190/18 A |
| 5,431,265 | A | * | 7/1995 | Yoo | 190/103 |
| 6,092,661 | A | * | 7/2000 | Mogil | 150/106 |
| 6,131,734 | A | * | 10/2000 | Hollingsworth et al. | 190/107 |
| 6,244,400 | B1 | * | 6/2001 | Bowers | 150/111 |

FOREIGN PATENT DOCUMENTS

| | | |
|---|---|---|
| FR | 2653312 | * 10/1990 |
| WO | WO 93/21793 | * 11/1993 |

OTHER PUBLICATIONS e–bags "Ballastic Nylon", cirica 1999.*
Palm Gear H.G. "Rhodiana Ballistic Nylon Case", 1997.*
Kolpin Product Magazine, pp. 1–36, date unknown.

* cited by examiner

*Primary Examiner*—David T. Fidei
(74) *Attorney, Agent, or Firm*—Brian G. Gilpin; Godfrey & Kahn, S.C.

(57) ABSTRACT

A handgun case for protecting and transporting a pistol or revolver, includes a closable outer shell; an inner liner within the outer shell; a variety of accessories removably attachable to the inner liner at any point on the inner liner, for example by hook-and-loop fasteners; a closed-cell foam pad between the outer shell and the inner liner; and a number of resilient protective ribs on the outer shell.

18 Claims, 3 Drawing Sheets

PISTOL CASE

BACKGROUND OF THE INVENTION

The present invention relates to a case for carrying a pistol or revolver and particularly to a pistol or revolver case with fully adjustable accessory pouches in the interior of the case.

SUMMARY OF THE INVENTION

A handgun case for protecting and transporting a pistol or revolver, comprising:

a) a closable outer shell;

b) an inner liner within the outer shell;

c) a plurality of accessories attachable to the inner liner wherein each of the accessories is removably attachable to the inner liner at any point on the inner liner;

d) a closed-cell foam pad between the outer shell and the inner liner; and e) a plurality of resilient protective ribs on the outer shell.

A principle object and advantage of the present invention is that it protects a handgun such as a pistol or revolver during transport from the home to a use location such as a firing range.

Another principle object and advantage of the present invention is that it securely holds a handgun in place during transport.

Another principle object and advantage of the present invention is that it is adaptable to handguns of various sizes and configurations.

A feature of the present invention is that it includes a number of accessories that may be removably attached to the interior of the case.

Another feature of the invention is that the accessories may be attachable at any point on the interior of the case.

Another feature of the present invention is that the accessories include handgun containment bars and a muzzle holder/positioner for securely retaining a handgun of any size or configuration within the case.

Another feature of the invention is that the outer shell of the case is padded to protect the contents.

Another feature of the invention is that the outer shell of the case has a number of resilient ribs to further protect the contents.

BRIEF DESCRIPTION OF DRAWINGS

FIG. 2 is similar to FIG. 1, showing a handgun in place within the case, shown in phantom lines.

DETAILED DESCRIPTION OF THE PREFERRED EMBODIMENT

Figure 1:
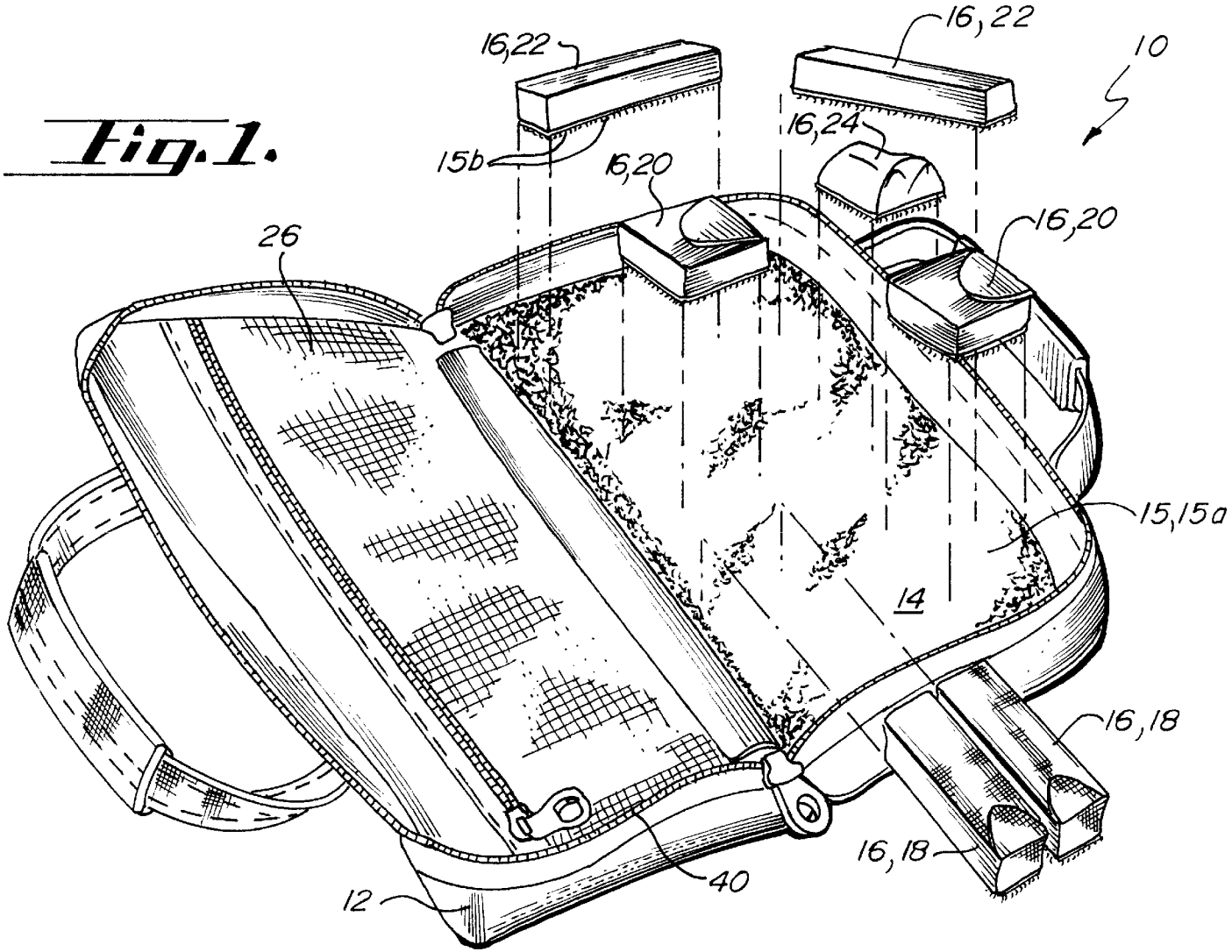
FIG. 1 is an exploded perspective view of the interior of the handgun case of the present invention, showing the placement of accessories within the case.
Figure 8:
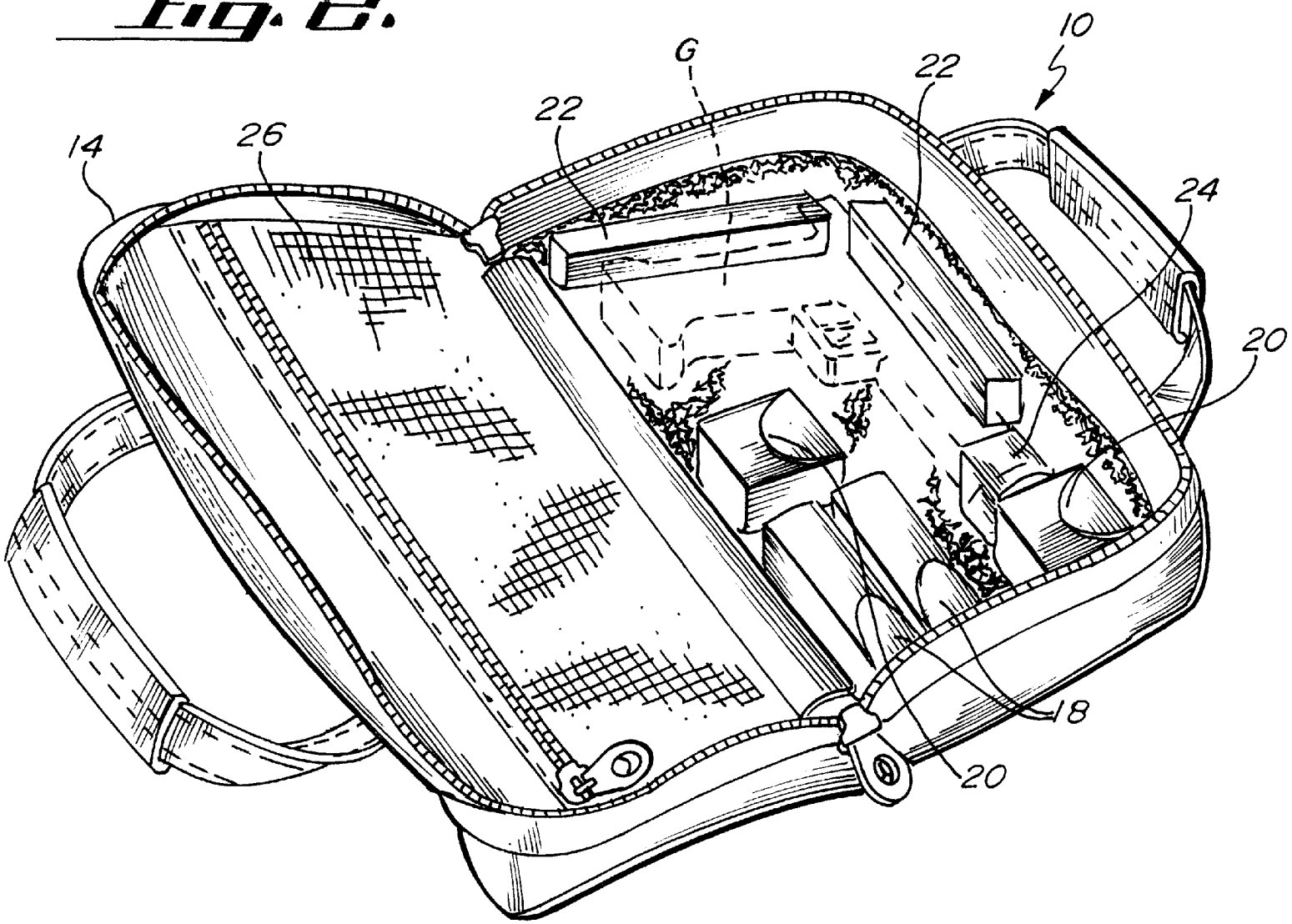

The handgun case of the present invention is generally shown in the Figures as reference numeral 10.

Turning first to FIG. 1, it can be seen that the handgun case 10 comprises a closable outer shell 12, an inner liner 14 within the outer shell 12, and a plurality of accessories 16 attachable to the inner liner 14.

The accessories 16 are preferably removable attachable to the liner 14. Most preferably the accessories 16 are removably attachable to the liner 14 at any point on the liner 14.

Without excluding other embodiments, the preferred removable method of attachment of the accessories 16 to the liner 14 is by having Velcro™ fabric 15 on both the accessories 16 and the liner 14. It will be recognized that the loop portion 15*a* of the Velcro™ may be either on the liner 14 or on the accessories 16; or, the hook portion 15*b* of the Velcro™ may be either on the liner 14 or the accessories 16. Other methods of attachment could include double-sided tape or retainers such as clips, pins, or zippers. However, the Velcro™ embodiment is most preferred since it allows the accessories 16 to be attached at any point on the liner 14.

The accessories can include any handgun accessory, but are preferably selected from the group consisting of magazine pouches 18, speedloader cases 20, handgun containment bars 22, and muzzle holder/positioner 24.

As best seen in FIG. 2, the handgun containment bars 22 may be used to position and hold a handgun G of any size and shape within the case, by attaching the containment bars 22 to the inner liner 14 so that the containment bars 22 abut against the gun G. The muzzle holder/positioner 24 cooperates with the handgun containment bars 22 to hold the handgun G securely in place within the case 10. It will be seen that by appropriate positioning of the containment bars 22 and muzzle holder/positioner on the liner 14, a handgun of any size and shape, such as a revolver or an automatic pistol, may be accommodated.

As shown in FIGS. 1 and 2, the inner liner 14 preferably includes a zippered compartment 26 attached thereon.

Figure 3:
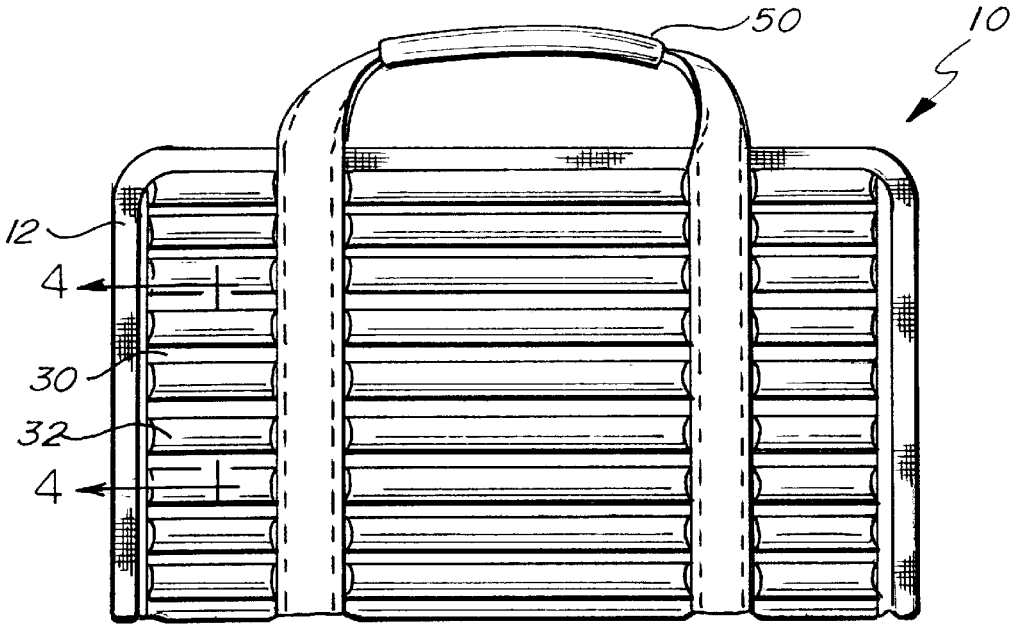
FIG. 3 is a left side elevation view of the case.

Turning to FIG. 3, the outside of the case 10 may now be appreciated. The outer shell 12 preferably comprises ballistic nylon. A plurality of resilient protective ribs 30 are placed on the outer shell 12 to cushion the case 10 and the handgun G against impact. Preferably, the ribs 30 are formed in a continuous protective outer pad 32, which may consist of rubber or other resilient material.

Figure 4:
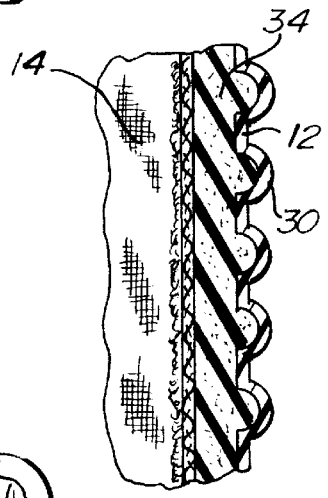
FIG. 4 is a cross-section taken at approximately the lines 4 of FIG. 3.

FIG. 4 is a cross-section through the case. As can be seen, there is an inner protective pad 34 between the outer shell 12 and the inner liner 14. The pad 34 may be any resilient material, but is preferably made of closed cell foam.

Figure 5:
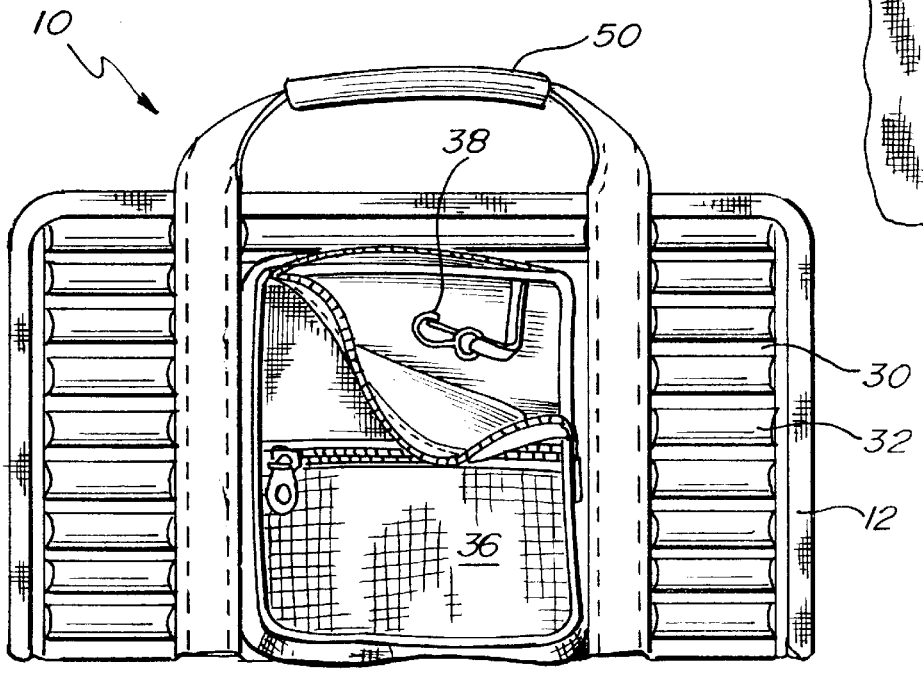
FIG. 5 is a right side elevation view of the case.

FIG. 5 is a view of the outside of the case from the opposite side. Preferably, a second zippered compartment 36 is placed on the outer shell 14 on this side of the case. A key retainer 38 may be attached within the compartment 36 to securely hold a set of keys.

Turning again to FIG. 1, it will be seen that preferably a zipper 40 runs around the periphery of the outer shell 12 to close the outer shell. Of course, the outer shell could be closed by equivalent structures such as clips, Velcro™, or the equivalent.

The case 10 also preferably includes a carrying handle 50.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A handgun case for protecting and transporting a pistol or revolver, comprising:

a book style, closable outer shell having a tray portion and a lid portion;

an inner liner substantially covering a bottom surface of the tray portion of the outer shell;

a first storage compartment in the lid portion of the outer shell; and a plurality of containment bars attached to the inner liner and configured to hold the pistol or revolver in place.

2. The handgun case of claim 1, wherein each of the accessories and containment bars is removably attachable to the inner liner.

3. The handgun case of claim 2 further comprising a muzzle positioner removably attached to the inner liner.

4. The handgun case of claim 3, wherein the inner liner further comprises a loop fabric and each of the accessories, containment bars, and muzzle positioner has a portion comprising hook fabric, whereby each of the accessories, containment bars, and muzzle positioner is removably attachable to the inner liner.

5. The handgun case of claim 3, wherein the inner liner further comprises a hook fabric and each of the accessories, containment bars, and muzzle positioner has a portion comprising loop fabric, whereby each of the accessories, containment bars, and muzzle positioner is removably attachable to the inner liner.

6. The handgun case of claim 1 further comprising a plurality of accessories attachable to the inner liner and selected from the group consisting of magazine pouches, speedloader cases, handgun containment bars, and muzzle holder/positioner.

7. The handgun case of claim 1, further comprising a zippered compartment attached to the inner liner.

8. The handgun case of claim 1, further comprising a pad between the outer shell and inner liner.

9. The handgun case of claim 8, wherein the pad is comprised of closed-cell foam.

10. The handgun case of claim 1, wherein the outer shell comprises ballistic nylon.

11. A handgun case for protecting and transporting a pistol or revolver, comprising:

a closable outer shell comprised of ballistic nylon;

an inner liner within the outer shell;

a plurality of containment bars configured to hold the pistol or revolver in place, wherein the containment bars are attachable to the inner liner;

a plurality of accessories attachable to the inner liner; and a plurality of resilient protective ribs on the outer shell.

12. The handgun case of claim 1, further comprising a zipper adapted to close the outer shell.

13. The handgun case of claim 1, further comprising a second storage compartment in the lid portion of the outer shell.

14. The handgun case of claim 13, further comprising a key retainer within either the first or second storage compartment on the outer shell.

15. A handgun case for protecting and transporting a pistol or revolver, comprising:

a closable outer shell comprised of ballistic nylon;

an inner liner within the outer shell;

a plurality of containment bars configurable to hold the pistol or revolver in place, wherein the containment bars are attachable to the inner liner;

a plurality of accessories removably attachable to the inner liner; and a plurality of resilient protective ribs on the outer shell.

16. The handgun case of claim 15, further comprising a zipper adapted to close the outer shell.

17. The handgun case of claim 15, further comprising a zippered compartment on the outer shell.

18. A handgun case for protecting and transporting a pistol or revolver, comprising:

a closable outer shell;

an inner liner within the outer shell;

a plurality of containment bars and a muzzle positioner configured to hold the pistol or revolver in place, wherein the containment bars and muzzle positioner are attachable to the inner liner;

a plurality of accessories attachable to the inner liner wherein each of the accessories is removably attachable to the inner liner at any point on the inner liner;

a closed-cell foam pad between the outer shell and the inner liner; and a plurality of resilient protective ribs on the outer shell.

* * * * *